US008931543B2

(12) United States Patent
Brondolin

(10) Patent No.: US 8,931,543 B2
(45) Date of Patent: Jan. 13, 2015

(54) DIE CASTING COOLED PISTONS

(75) Inventor: Davide Brondolin, Gallarate (IT)

(73) Assignee: Brondolin S.p.A., Cassano Magnago (IT)

( * ) Notice: Subject to any disclaimer, the term of this patent is extended or adjusted under 35 U.S.C. 154(b) by 0 days.

(21) Appl. No.: 13/145,697

(22) PCT Filed: Jan. 18, 2010

(86) PCT No.: PCT/IB2010/050223
§ 371 (c)(1),
(2), (4) Date: Sep. 29, 2011

(87) PCT Pub. No.: WO2010/084454
PCT Pub. Date: Jul. 29, 2010

(65) Prior Publication Data

US 2012/0031580 A1 Feb. 9, 2012

(30) Foreign Application Priority Data

Jan. 21, 2009 (IT) ..... MI2009A0061

(51) Int. Cl.
*B22D 17/04* (2006.01)
*B22D 41/005* (2006.01)
*B22D 17/20* (2006.01)

(52) U.S. Cl.
CPC ..... *B22D 17/203* (2013.01)
USPC ..... 164/312; 164/348

(58) Field of Classification Search
USPC ..... 164/4.1, 458, 303–313, 348, 113
See application file for complete search history.

(56) References Cited

U.S. PATENT DOCUMENTS

| | | | | |
|---|---|---|---|---|
| 4,311,185 | A * | 1/1982 | Zimmerman | 164/315 |
| 4,842,039 | A * | 6/1989 | Kelm | 164/312 |
| 5,233,912 | A * | 8/1993 | Mueller | 92/29 |
| 5,979,298 | A * | 11/1999 | Whitacre | 92/211 |
| 2009/0071326 | A1 * | 3/2009 | Schivalocchi et al. | 92/255 |
| 2009/0139683 | A1 * | 6/2009 | Muller et al. | 164/312 |

FOREIGN PATENT DOCUMENTS

| | | | |
|---|---|---|---|
| DE | 2904883 | B1 | 7/1979 |
| DE | 3323328 | C1 | 5/1984 |
| DE | 4019076 | A1 | 12/1991 |
| DE | 19938075 | A1 | 10/2000 |
| DE | 102005048717 | A1 | 4/2007 |
| GB | 551855 | A | 3/1943 |
| JP | 2006212696 | A | 8/2006 |
| WO | 03074211 | A2 | 9/2003 |
| WO | 03074211 | A3 | 9/2003 |
| WO | WO 2007042282 | A2 * | 4/2007 |

* cited by examiner

*Primary Examiner* — Kevin P Kerns
*Assistant Examiner* — Steven Ha
(74) *Attorney, Agent, or Firm* — Ungaretti & Harris LLP

(57) ABSTRACT

The invention relates to a die casting piston (20) and a respective support (2). The piston has a wall (21) in which channels for a coolant flow are obtained: this improves the thermal exchange between the piston and the coolant, leading to greater cooling efficiency.

7 Claims, 7 Drawing Sheets

DIE CASTING COOLED PISTONS

This application is a United States National stage application under 35 U.S.C. Section 371 of International Patent Application No. PCT/IB2010/050223 filed on Jan. 18, 2010, claiming priority to Italian Patent Application No. MI2009A000061 filed Jan. 21, 2009, both of which are hereby incorporated by reference as if fully set forth herein.

The present invention relates to a piston for pressure die casting, in particular for, without being limited to, cold-chamber die casting processes.

It is appropriate to specify beforehand that, although in the following description reference will be made for simplicity mainly to cold-chamber pressure die casting, this should not however be understood as a limiting factor, since the present invention is also applicable to, unless specifically incompatible with, other types of pressure die casting processes (e.g. hot-chamber die casting) for metallic or non-metallic materials.

The cold-chamber pressure die casting process has been known for a long time, and therefore it will not be described in detail below, with the exception of what is strictly needed in order to understand the invention. For further information, reference should be made to the numerous technical and scientific publications on this matter.

In this process, molten metal is poured into a container having a cylindrical inner cavity, in which the metal is pushed by a moving piston towards an axial outlet, thereby being injected into a die containing the mould of the part to be cast.

This type of process is mostly used for producing parts made of aluminium-based light alloys, but its field of application has been recently extended to magnesium as well; the temperatures involved may reach quite high values (over 400-500° C.), and therefore piston cooling is an important factor for the proper execution of the production process.

According to the current state of the art, in these applications the piston is cooled by a liquid which is delivered to the most thermally stressed region, i.e. the piston head, which comes directly in contact with the molten metal, and is then evacuated along an inverse path.

In particular, the liquid flows into an axial duct within the support on which the piston is mounted, leading to the piston head; the liquid is spread onto the inner wall of the piston head through radial channels provided at the support end.

The coolant flow is thus distributed in a sunburst pattern and is then collected into a circular channel encircling the piston support, from which it finally returns to the support's axial portion to be evacuated.

Some examples of pistons cooled in this manner are described in European patent application EP 423 413 published on Apr. 24, 1991 and in International patent application PCT/IT2007/000255 published on Oct. 18, 2007.

While from a general viewpoint the cooling systems known in the art are considered to be reliable because they have been tested for a long time, the higher temperatures nowadays involved in pressure die casting processes, as aforementioned, give rise to the need of improving the efficiency of the thermal exchange between the piston and the coolant.

As a matter of fact, casting magnesium and its alloys makes the piston become very hot: it follows that, in order to remove more heat, there is no other solution than to act upon the thermal exchange area lapped by the coolant, i.e. to increase the piston dimensions.

However, this is not always feasible, because it would also require changes to the container in which the piston slides, so that de facto this solution is not applicable to existing pressure die casting fixtures, which otherwise should be replaced, involving high costs.

The technical problem at the basis of the present invention is therefore to improve the above-described state of the art.

In other words, the problem is to provide a pressure die casting piston which is cooled with greater efficiency than possible through the prior art.

A piston having the same diameter as the existing ones can thus be manufactured which, all other conditions being equal (coolant flow rate, wall length, etc.), ensures better performance because it is cooled more effectively.

The idea which provides a solution to the above-mentioned technical problem is to let the coolant flow within the piston wall: in this manner, the heat is removed directly from within the latter, thus increasing the thermal exchange.

The better piston cooling allows to increase the number of die casting cycles while still keeping the piston temperature under preset values ensuring the proper operation of the machine.

As a result, the productivity of the die casting equipment is increased as well, with evident advantages from an industrial point of view.

The aforementioned technical problem is solved by a piston having the features set out in the appended claims.

Said features and the advantages thereof will become more apparent from the following description of an embodiment of the piston according to the invention referring to the annexed drawings, wherein.

Figure 1:
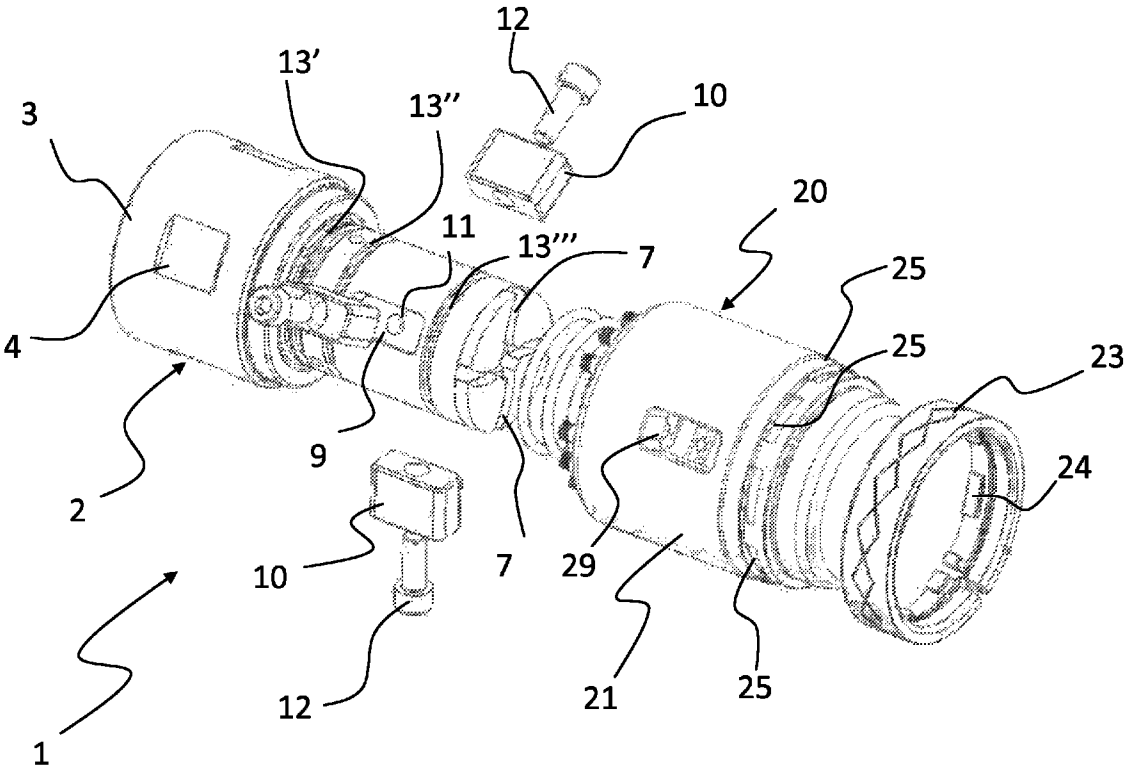
FIGS. 1 and 2 are two exploded views from different angles of a piston and a piston support according to the present invention.
Figure 2:
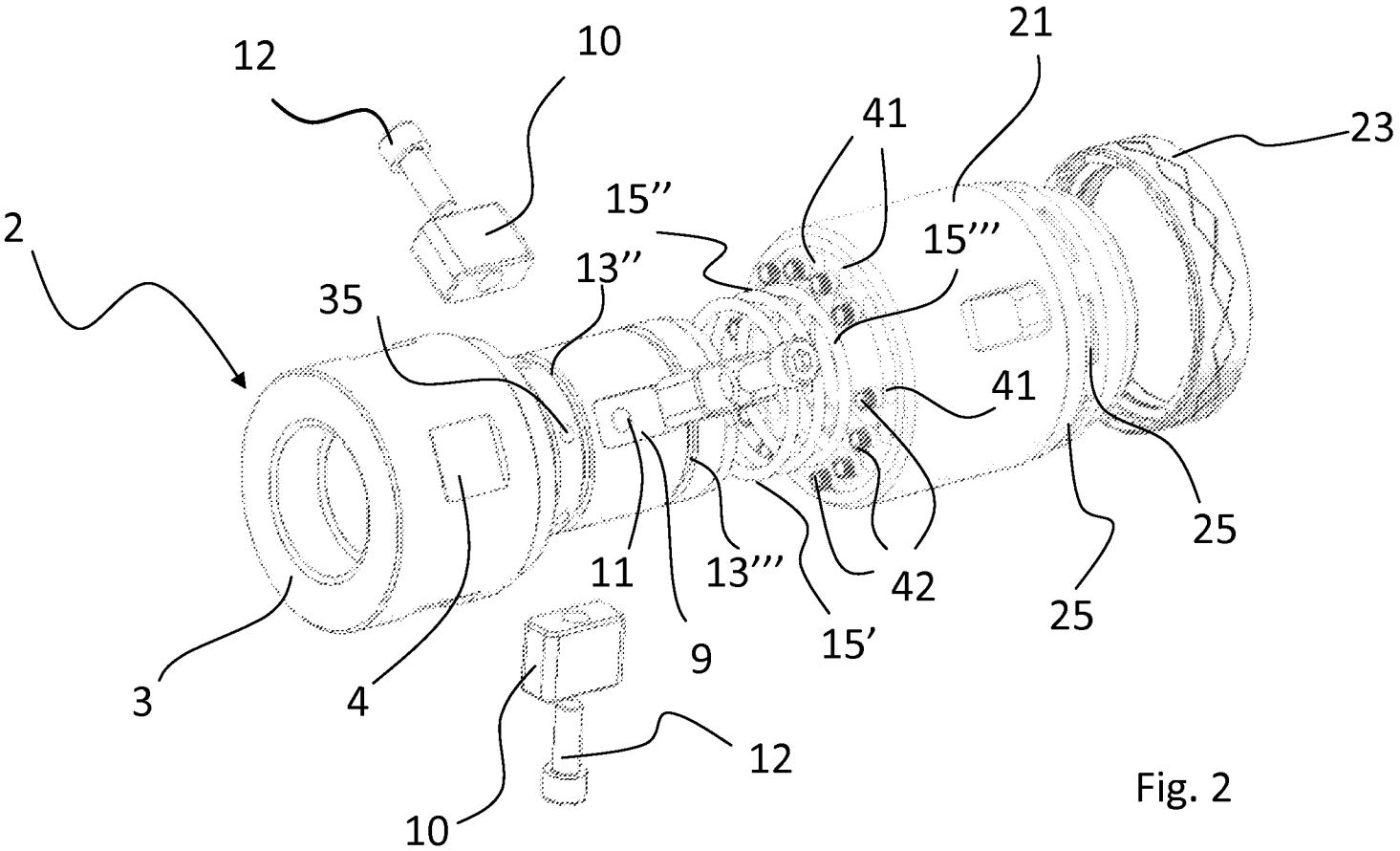
Figure 3:
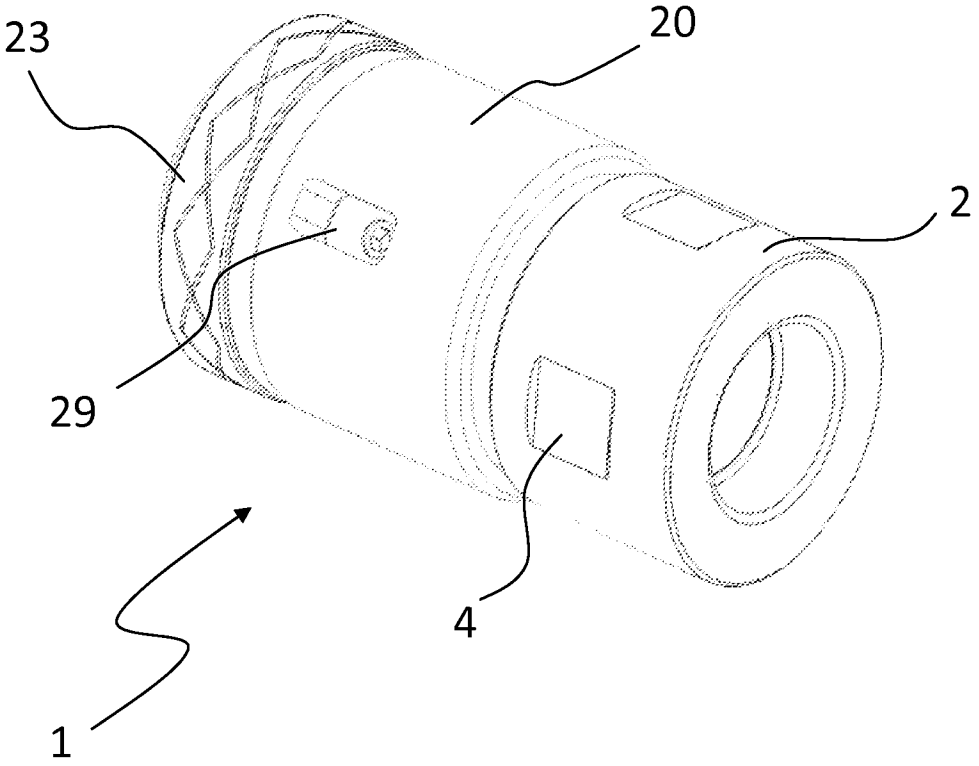
FIG. 3 shows the piston and the support of the preceding figures in the assembled condition.

Referring now to the above-listed drawings, numeral 1 designates as a whole a pressure die casting piston-support assembly in accordance with the invention.

The assembly comprises a support 2 having a cylindrical geometry, with a base 3 having the usual bevelled faces 4 to be engaged with tools (such as spanners or the like) for mounting the assembly onto the die casting fixture.

Extending from base 3, support body 5 is axially hollow and has, at its front end, grooves 7 extending outwards from the centre, which will be described in detail later on. On support body 5 there are seats 9 to be engaged with piston clamping keys 10; in this example, seats 9 are three, spaced by 120°: their number may however be greater or smaller than three, depending on specific requirements.

At the bottom of seats 9 there is a threaded hole 11 having the same diameter as the shank of screws 12 used for securing the keys 10.

Finally, along the piston support body 5 there are annular grooves 13', 13" and 13'" for respective ring-type sealing gaskets (O-rings) 15', 15" and 15'"; the number of grooves and gaskets may differ from this example, but the number suggested herein ensures optimal coolant circulation in the wall.

Referring now to piston 20, it comprises a cylindrical side wall 21 closed at the front by a head 22, around which a sealing ring 23 is applied.

According to a preferred embodiment, sealing ring 23 has radial inner teeth 24 to be engaged into matching seats 25 obtained in the base of piston head 22.

The outer surface of ring 23 may be smooth, like most known rings, or it may have a groove 26 which in this example has a fret design, as can be seen in the drawings, but may also have an annular or a different profile.

Radial apertures 29 in the wall 21 align with seats 9 when the piston is mounted on support 2, thus allowing for the insertion of keys 10: the latter lock wall 21 to support body 5, preventing it from turning or moving axially.

Clamping the piston by means of keys is the preferred solution of the invention, because the piston is locked securely to support 2 both rotationally and translationally; however, this is not the only feasible method.

For example, a conceivable alternative may be a traditional threaded system allowing the piston to be screwed onto piston body 5, or else a bayonet-type system, both of which are known in the art.

For cooling piston 20, channels 30 are obtained in cylindrical wall 21 and extend parallel to one another along the wall generatrices, between an annular distribution chamber 32 encircling the front end of support body 5 and an annular collection chamber 33.

The collection chamber is arranged at the wall base, in the space defined between two seats 13', 13" for respective sealing rings 15', 15".

The liquid collected in chamber 33 can thus flow towards a series of radial collectors 35 formed inside body 5 of support 2.

Figure 6:
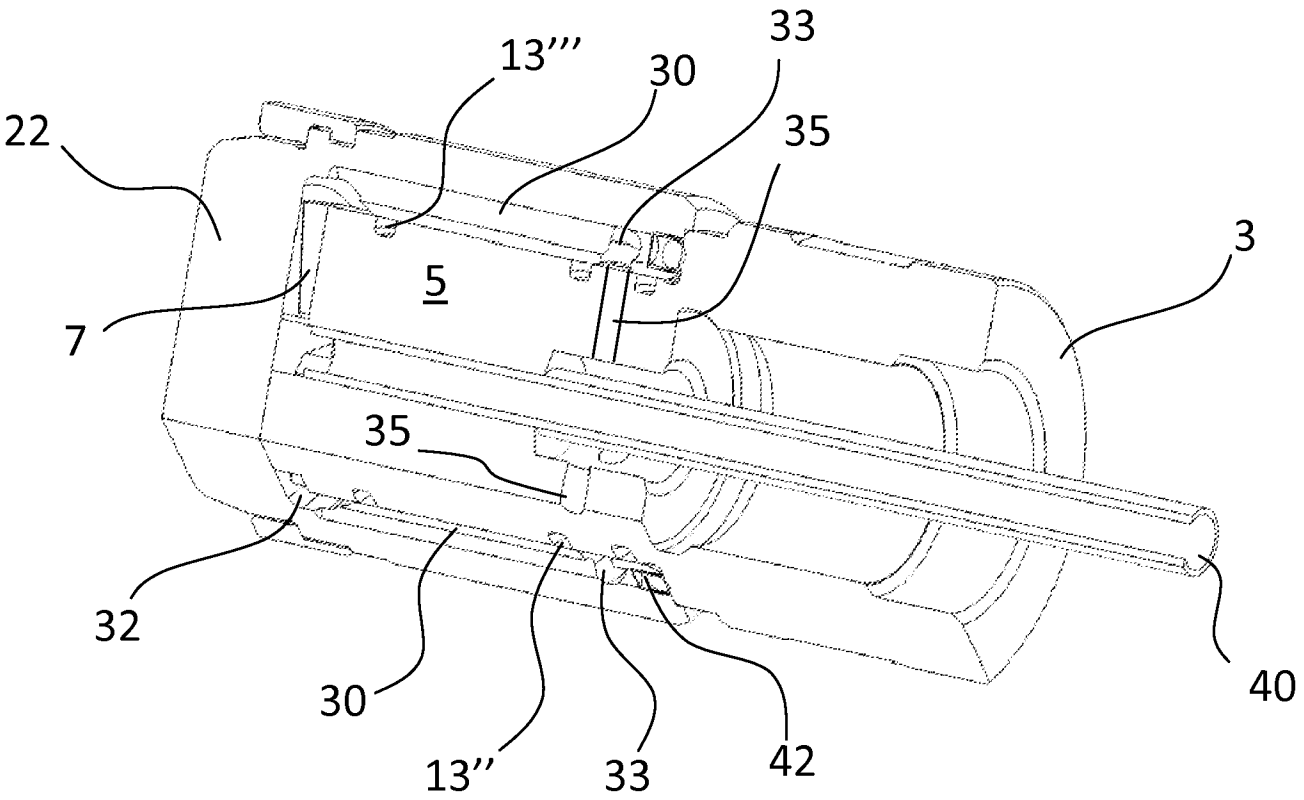
FIG. 6 is a longitudinal view in a plane intersecting both the piston and the piston support, showing the coolant supply duct.
Figure 7:
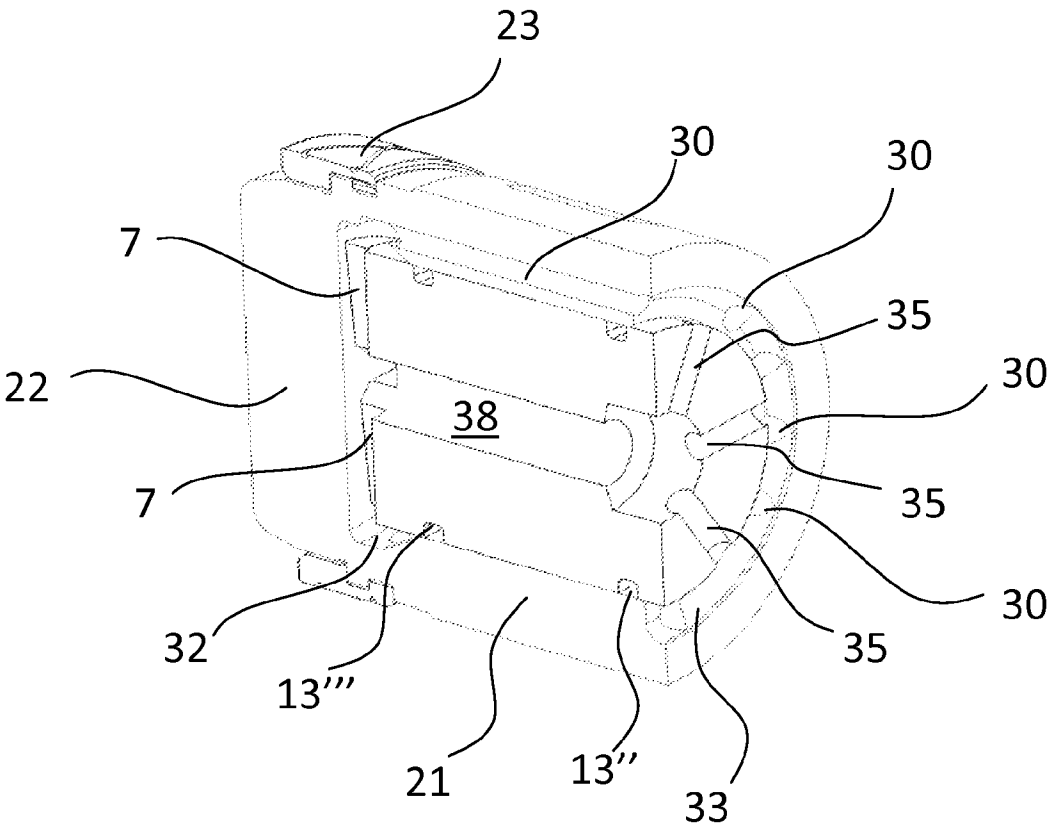
FIG. 7 is a longitudinal cross-section of the piston and of a portion of the piston support, highlighting the radial collectors.

As aforesaid, the latter is hollow axially; in particular, cavity 38 passing through it in the longitudinal direction houses a pipe 40 (sectioned in FIG. 6) which delivers the coolant to the end of body 5.

From there, the coolant flow branches off into grooves 7 to reach the above-mentioned distribution chamber 32, and then follows the path along channels 30.

Coolant evacuation takes place along a path outside pipe 40: the coolant flow coming from collection chamber 33 is conveyed axially by collectors 35 into the interspace surrounding pipe 40, from where it flows on inside base 3 of support 2 to be drained out. In this respect, it should be pointed out that the position of ring-type gaskets 15', 15", 15'" and of respective seats 13', 13", 13'" on support body 5 turns out to be particularly advantageous for piston cooling, in that it prevents any coolant leakage.

In fact, the coolant is fed axially to distribution chamber 32 by pipe 40 and grooves 7; at this stage, the presence of gasket 15'" adjacent to the end of support body 5 proves to be extremely important to prevent coolant dispersion.

Thanks to this seal, in fact, the liquid will flow on from grooves 7 to distribution chamber 32 and then into channels 30, downstream of which it will enter collection chamber 33; in this case as well, it must be highlighted that, if gaskets 15', 15" were not present, the liquid would spread between the inner wall of wall 21 and body 5 instead of flowing through radial collectors 35 to be evacuated.

In other words, locating collectors 35 in the region comprised between sealing gaskets 15' and 15" is important for cooling the piston properly.

Moreover, it is barely worth mentioning that, although in this example the gaskets are installed into seats 13', 13" formed on body 5, said seats may alternatively be obtained on the inner wall of the wall.

Finally, as a further characteristic feature of the invention, it is necessary to point out that in this example, for mechanically drilling the channels 30 into the wall (by using a cutter, a drill or the like), a tool penetrating into the wall 21 from the lower edge thereof has been advantageously used: this is a low-cost solution, since it can be implemented by using traditional machinery and tools.

Figure 4:
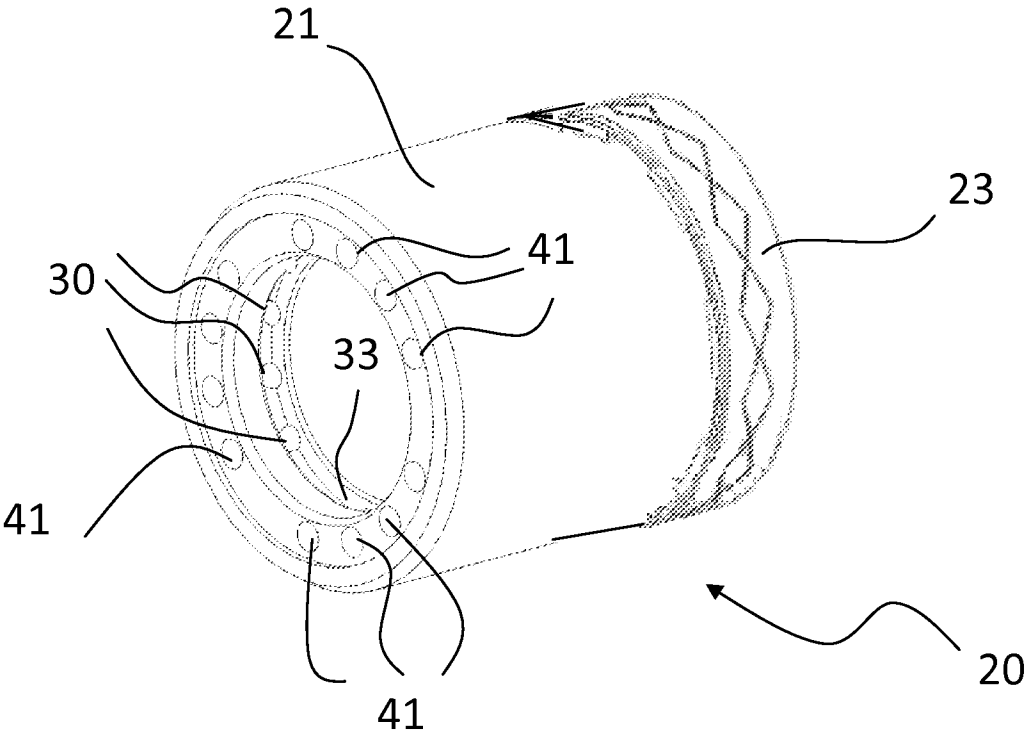
FIG. 4 is a detailed view of the piston of the preceding figures, without the support.
Figure 5:
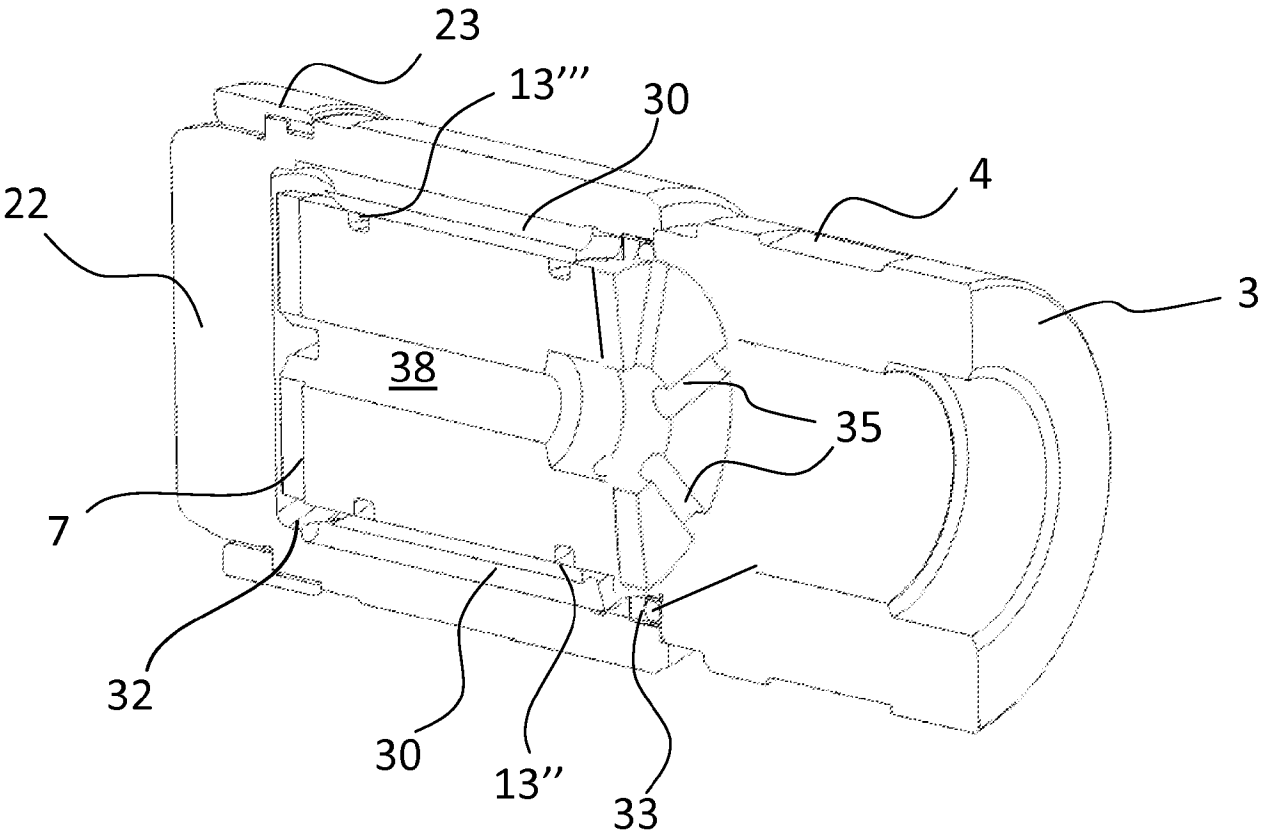
FIG. 5 is a longitudinal sectional view of the piston of the preceding figures mounted on its support.

Sealing elements 42 are used for closing tool entry holes 41 (visible in FIG. 4); these may be removable elements provided, for example, in the form of threaded plugs (of course, entry holes 41 will have to be threaded too), or permanent elements obtained by lead sealing or through deformable caps or bushes.

Removable plugs bring the advantage of allowing maintenance of channels 30, even though the latter are generally more costly to make (in addition to tapping holes 41), whereas lead sealing or using non-removable, permanently deformable caps is to be preferred for small piston applications.

It can be easily understood from the above description how piston 20 can solve the technical problem addressed by the invention.

In fact, it is apparent that, since channels 30 that carry the coolant are obtained inside piston wall 21, the thermal exchange between coolant and piston is considerably improved; as a result, more heat is removed, all other conditions being equal (coolant flow rate, temperature of the molten metal to be die cast, die casting speed, etc.).

In particular, it must be observed that in this case the coolant exchanges heat with a generally larger surface than in prior-art pistons.

In fact, in the latter the liquid only touches the inner wall of the piston wall, which wall has a shorter radius than the inner region comprised between channels 30 and the outer surface of wall 21; in addition, according to the present invention the liquid exchanges heat with the whole inner wall of channels 30, the area of which, if said channels are sized appropriately and in a sufficient number, is larger than the inner surface of the piston wall.

It must also be added that the presence of channels 30 in the wall 21, i.e. the presence of gaps in the latter's wall, reduces its heat-conductive metallic mass (of copper or the like) and hence the wall's thermal capacity (as known, thermal capacity is given by the relation $Q=c\times M\times\Delta T$, where c is the specific heat of the material, M is the overall mass thereof, and $\Delta T$ is the temperature variation).

It follows that in the present invention the coolant is put into thermal exchange with a smaller metallic mass, and therefore, the flow rate being equal, it is necessary to remove less heat in order to cool down said mass.

These advantageous effects are attained without modifying the outside dimensions of piston 20, which is thus compatible with the existing ones and can be used on die casting fixtures currently in use.

It must nevertheless be remarked that channels 30 may also be obtained through a different type of machining, e.g. by laser or electroerosion.

In such a case, tool entry holes 41 may be unnecessary, and even the shape of channels 30 may not be straight as in the example shown. For example, it may be conceivable to provide a spiral channel extending along the wall 21.

It should also be pointed out that wall 21, though preferably made in one piece, may however also be obtained by coupling together two pieces, i.e. an external sleeve coupled to a tubular inner part.

In such a case, channels 30 or the single spiral channel may be obtained on one of the two pieces coupled together, still obtaining a wall equivalent to that of the example described above, wherein the wall is a single piece.

In this frame, the invention also achieves further advantages related to the particular technical solutions employed.

For example, keys 10 allow piston 20 to be firmly locked onto support 2, preventing them from turning and moving axially relative to each other, while still remaining easily accessible from the outside, in order to be removed by undoing bolts 12, at every maintenance inspection.

Likewise, radial teeth 24 on sealing ring 23 and seats 25 on piston 20 allow the sealing ring to be locked to the piston; to this end, the ring is preferably of the open type, i.e. it has a cutout that allows it to expand elastically, so that it can be easily removed when necessary.

It is apparent that both the key-type piston clamping system and the radial-tooth-type ring locking system may be replaced with different solutions, like those used for prior-art pistons.

As far as the sealing ring is concerned, it is finally necessary to underline that the groove provided on its outer surface, which improves the lubrication of the piston to advantage of the die casting process, may be omitted without jeopardizing the other effects achieved by the invention.

These variants will still fall within the scope of the following claims.

The invention claimed is:

1. A pressure die casting piston assembly comprising:

a pressure die casting piston comprising:

a front head;

a substantially cylindrical side wall extending upwardly from the front head;

at least one coolant channel for a coolant flow passing through the side wall, so as to let the coolant flow within the side wall; and a plurality of straight channels extending longitudinally along the cylindrical side wall, and wherein the straight channels are provided for inserting tools adapted to create said coolant channels, the straight channels being closed by means for sealing.

2. The pressure die casting piston assembly of claim 1, wherein the means for sealing the holes comprises caps which can be deformed permanently.

3. A pressure die casting piston assembly comprising:

a pressure die casting piston comprising:

a front head;

a substantially cylindrical side wall extending upwardly from the front head; and at least one coolant channel for a coolant flow passing through the side wall, so as to let the coolant flow within the side wall; and a support comprising a base for mounting the piston onto a pressure die casting equipment and a body extending from said base and further a groove for a sealing gasket adjacent an end of a body, wherein the support further comprises a plurality of collectors extending in the body from near the base, in a region between two sealing gaskets.

4. The pressure die casting piston assembly of claim 3, wherein the gaskets are ring-shaped and respective seats are provided on the body for housing said gaskets, between which the collectors for the coolant flow are arranged.

5. The pressure die casting piston assembly of claim 4, wherein the support is axially hollow.

6. A pressure die casting piston comprising:

a front head;

a substantially cylindrical side wall extending upwardly from the front head;

at least one coolant channel for a coolant flow passing through the side wall; and a plurality of straight channels extending longitudinally along the cylindrical side wall, and wherein the straight channels are provided for inserting tools adapted to create said coolant channels, the straight channels being closed by means for sealing.

7. The pressure die casting piston of claim 6, wherein the means for sealing the straight channels comprises caps which can be deformed permanently.

* * * * *